US010544757B2

(12) United States Patent
Fujisaki

(10) Patent No.: US 10,544,757 B2
(45) Date of Patent: Jan. 28, 2020

(54) CHECK VALVE DEVICE AND VAPOR FUEL SUPPLY SYSTEM

(71) Applicant: Hamanakodenso Co., Ltd., Kosai, Shizuoka-Pref. (JP)

(72) Inventor: Yoshihiko Fujisaki, Kosai (JP)

(73) Assignee: HAMANAKODENSO CO., LTD., Kosai, Shizuoka-Pref. (JP)

( * ) Notice: Subject to any disclaimer, the term of this patent is extended or adjusted under 35 U.S.C. 154(b) by 113 days.

(21) Appl. No.: 15/214,482

(22) Filed: Jul. 20, 2016

(65) Prior Publication Data

US 2017/0030301 A1 Feb. 2, 2017

(30) Foreign Application Priority Data

Jul. 27, 2015 (JP) ..... 2015-148071

(51) Int. Cl.

| | |
|---|---|
| ***F02M 25/08*** | (2006.01) |
| ***F02M 35/02*** | (2006.01) |
| ***F02M 35/10*** | (2006.01) |
| ***F02M 35/024*** | (2006.01) |
| ***F02M 35/104*** | (2006.01) |

(52) U.S. Cl.

CPC .... *F02M 25/0836* (2013.01); *F02M 25/0854* (2013.01); *F02M 35/024* (2013.01); *F02M 35/104* (2013.01); *F02M 35/10157* (2013.01); *F02M 35/10268* (2013.01)

(58) Field of Classification Search

CPC ..... F02M 25/0836; F02M 35/10157; F02M 25/0854; F02M 35/024; F02M 35/10268; F02M 35/104; Y10T 137/7891; Y10T 137/7888; Y10T 137/789; Y10T 137/7892; F16K 15/148

USPC ..... 137/852, 854, 855, 856

See application file for complete search history.

(56) References Cited

U.S. PATENT DOCUMENTS 4,054,152 A * 10/1977 Ito ..... F16K 15/148 137/512
4,513,784 A * 4/1985 Farrand ..... F16K 15/148 137/516.11
4,556,086 A * 12/1985 Raines ..... F16K 15/141 137/843

(Continued)

FOREIGN PATENT DOCUMENTS

JP 2005-172206 A 6/2005
JP 2014-111915 A 6/2014
WO WO-2012003776 A1 * 1/2012 ..... F16K 15/148

*Primary Examiner* — Hung Q Nguyen
*Assistant Examiner* — Brian P Monahon
(74) *Attorney, Agent, or Firm* — Harness, Dickey & Pierce, P.L.C.

(57) ABSTRACT

A check valve device includes a valve portion elastically deformable to prevent or allow a flow of a vapor fuel through a fluid passage in one direction by contacting with or separating from a valve seat. An upstream passage forming member has the valve seat and the fluid passage located upstream of the valve portion. A downstream passage forming member includes a terminal portion housed in the upstream passage forming member and having a downstream passage. A narrowed passage provided inside the terminal portion or between the upstream passage forming member and the terminal portion. A cross-sectional area of the narrowed passage is set to be smaller than any of the fluid passage and the downstream passage.

20 Claims, 13 Drawing Sheets

(56) References Cited

U.S. PATENT DOCUMENTS 4,749,003 A * 6/1988 Leason ..... F16K 15/148 137/854
4,762,149 A * 8/1988 Pickl, Jr. ..... F16K 15/141 137/843
5,598,872 A * 2/1997 Kasugai ..... F16K 15/025 137/852
5,601,112 A * 2/1997 Sekiya ..... F16K 15/148 137/512.15
5,605,177 A * 2/1997 Ohashi ..... B60K 15/03519 123/516
5,749,347 A * 5/1998 Torii ..... B60K 15/03519 123/509
5,881,686 A * 3/1999 Schmidt ..... F01M 13/023 123/41.86
6,070,728 A * 6/2000 Overby ..... B65D 77/225 137/526
6,343,505 B1 * 2/2002 Cook ..... F02M 25/0809 73/114.39
6,537,354 B2 * 3/2003 Meiller ..... F02M 25/0854 123/519
6,840,262 B2 * 1/2005 Kojima ..... F16K 17/19 137/202
6,874,523 B2 * 4/2005 Yoshihara ..... B60K 15/03519 137/202
6,981,491 B2 * 1/2006 Schmitt ..... F02M 37/0023 123/456
7,438,090 B2 * 10/2008 Steele ..... F16K 15/141 137/515.5
7,546,833 B2 * 6/2009 Tomomatsu ..... F02M 37/106 123/509
7,628,143 B2 * 12/2009 Yamada ..... F02M 37/106 123/509
7,896,022 B2 * 3/2011 Benjey ..... B60K 15/03504 123/516
8,459,237 B2 * 6/2013 Erdmann ..... B60K 15/04 123/516
8,561,638 B2 * 10/2013 Yamaguchi ..... B60K 15/03519 137/493.6
9,086,036 B2 * 7/2015 Inoguchi ..... F02M 25/0836
9,097,356 B2 * 8/2015 Yamaguchi ..... F02M 37/20
2002/0002350 A1 * 1/2002 Larrain ..... A61M 39/24 604/247
2004/0020289 A1 * 2/2004 Gouzou ..... F02M 37/103 73/313
2005/0022796 A1 * 2/2005 Zuchara ..... B01D 53/0415 123/519
2005/0126649 A1 6/2005 Onishi
2006/0037587 A1 * 2/2006 McClure ..... F02M 33/08 123/509
2007/0163664 A1 * 7/2007 Mijers ..... F16K 15/144 137/859
2007/0215121 A1 * 9/2007 Attwood ..... F02M 37/0094 123/509
2008/0257321 A1 * 10/2008 Knaus ..... F01M 13/0011 123/574
2010/0152680 A1 * 6/2010 Mcmahon ..... A61M 39/24 604/247
2010/0215522 A1 * 8/2010 Kawamura ..... F04B 17/04 417/410.1
2010/0300556 A1 * 12/2010 Carmody ..... A61M 39/24 137/528
2011/0030659 A1 * 2/2011 Ulrey ..... F02M 25/089 123/521
2011/0088400 A1 * 4/2011 Shudo ..... F02D 19/02 60/734
2012/0138171 A1 * 6/2012 Coolens ..... F01M 13/04 137/511
2013/0008413 A1 * 1/2013 Inoguchi ..... F02M 25/0836 123/518
2014/0345573 A1 * 11/2014 Jefford ..... F02M 25/0836 123/519

* cited by examiner

CHECK VALVE DEVICE AND VAPOR FUEL SUPPLY SYSTEM

CROSS REFERENCE TO RELATED APPLICATION

This application is based on and incorporates herein by reference Japanese Patent Application No. 2015-148071 filed on Jul. 27, 2015.

TECHNICAL FIELD

The present disclosure relates to a check valve device used for a system which supplies a vapor fuel from a canister to an intake pipe in an automobile, and relates to a vapor fuel supply system including the check valve device.

BACKGROUND

As an example of a conventional check valve device, a device disclosed by Patent Document 1 (JP 2005-172206 A corresponding to US 2005-0126649 A1) is known. The check valve device of Patent Document 1 obtains a sealing effect by line contact between an outer circumferential rim of an upstream side of a sealing part of a rubber valving element and a circular edge of a partition wall, and prevents a backward flow. The valving element is a component in which a valve portion having the umbrella-shaped sealing part and a shaft portion extending perpendicularly to the valve portion are formed integrally with each other. The partition wall includes a support portion supporting the shaft portion of the valving element, multiple fluid through-holes arranged at regular intervals around the support portion, and the circular edge circularly surrounding an outer side of the multiple fluid through-holes. The circular edge constitutes a valve seat formed into a size corresponding to the outer circumferential rim of the upstream side of the sealing part.

In the conventional check valve device, the valving element having the umbrella-like shape and made of rubber is used. In this case, the valving element may repeatedly deform elastically and abruptly depending on change in pressure acting on the valving element. By the repetition of the abrupt deformations of the valving element, a stress may generate in the valving element repeatedly. Accordingly, durability of the valving element may decrease.

SUMMARY

It is an object of the present disclosure is to provide a check valve device or a vapor fuel supply system which is capable of improving durability of a valve portion.

According to an aspect of the present disclosure, a check valve device is capable of limiting a flow of a vapor fuel passing through a fluid passage in one direction. The check valve device includes a valve portion, an upstream passage forming member, a downstream passage forming member, and a narrowed passage. The valve portion extends radially outward from a valve shaft, and the valve portion is elastically deformable depending on a direction of a pressure of the vapor fuel. The valve portion is configured to prevent or allow a flow of the vapor fuel through the fluid passage by contacting with or separating from a valve seat located downstream of the fluid passage in accordance with an elastic deformation of the valve portion. The upstream passage forming member includes the fluid passage and the valve seat, and supports the valve shaft. The downstream passage forming member includes a terminal portion having therein a downstream passage through which the vapor fuel passed out of the fluid passage flows downstream. The downstream passage forming member is connected to the upstream passage forming member while the terminal portion is housed in the upstream passage forming member. The narrowed passage is provided inside the terminal portion or between an inner wall surface of the upstream passage forming member other than the valve seat and an outer circumferential surface of the terminal portion. A cross-sectional area of the narrowed passage is set to be smaller than any of the fluid passage and the downstream passage.

Accordingly, since the narrowed passage having the smaller cross-sectional area than any of the fluid passage and the downstream passage is located downstream of both the fluid passage and the valve portion, a drastic reduction in pressure difference between the fluid passage and the downstream passage can be restricted at a valve opening time when the valve portion is separated from the valve seat. The vapor fuel flowing out of the fluid passage at the valve opening time passes through the narrowed passage having the smaller cross-sectional area than the fluid passage. Thus, a pressure of in the fluid passage can be kept high relative to a pressure in the downstream passage. Accordingly, the pressure difference between the fluid passage and the downstream passage is maintained for a while, and the pressure difference can be reduced gradually. The reduction in decrease rate of the pressure difference can improve a condition of the valve portion such that the valve portion does not return drastically to its original shape via an elastic deformation toward the valve seat by a restoring force of the valve portion. Therefore, a frequency of alternate elastic deformations of the valve portion between valve closing and valve opening can be reduced, and thus repetition of impact stress on the valve portion can be limited. The check valve device capable of improving durability of the valve portion can be provided.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Figure 12:
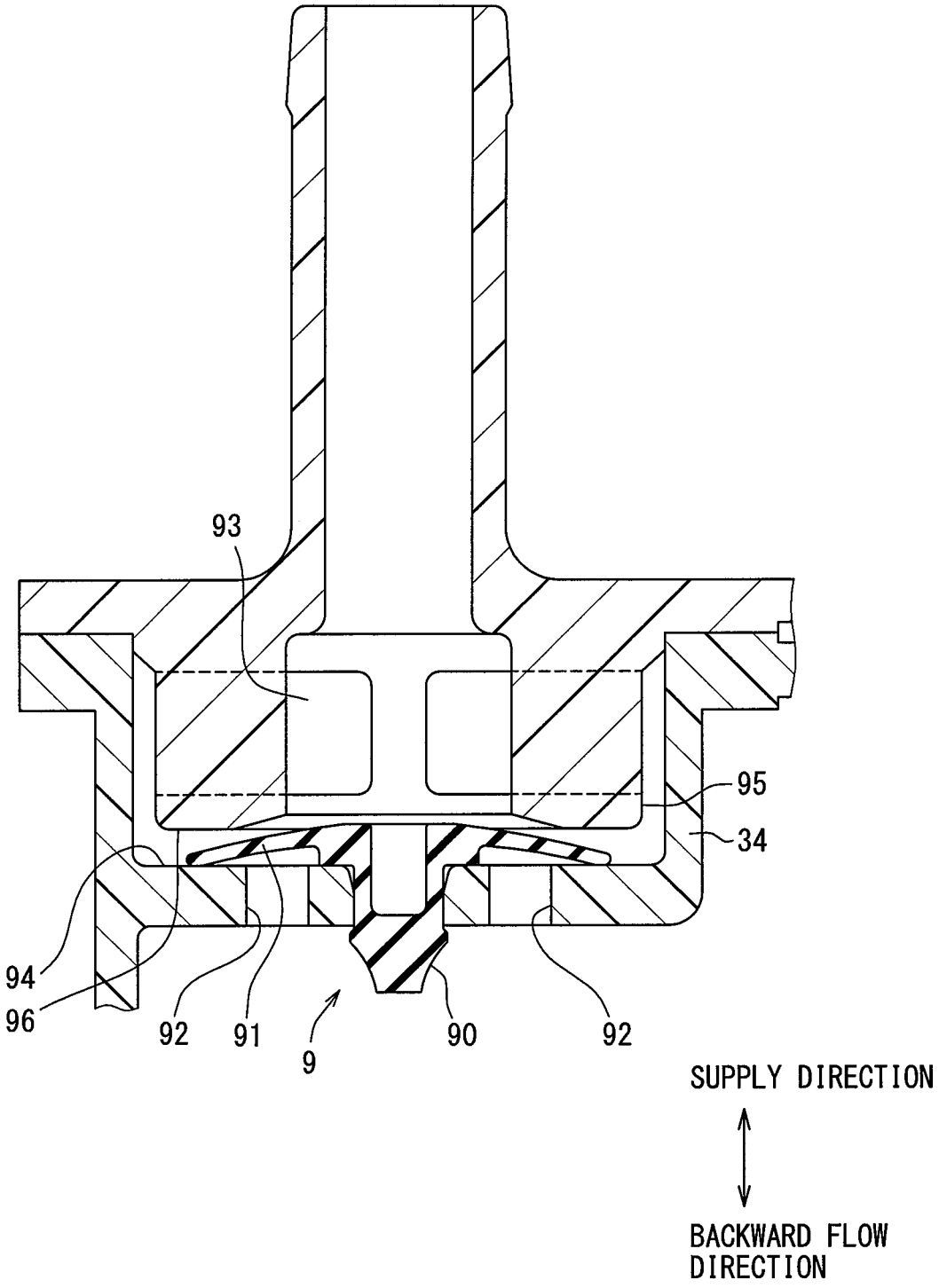
FIG. 12 is a sectional view illustrating the check valve device in a valve closed state, according to a comparative example of the present disclosure.

A mechanism of durability deterioration of a valving element in a check valve device 9 used for a vapor fuel supply system according to a comparative example of the present disclosure will be described referring to FIGS. 12 and 13. When an intake air pressure of an engine increases, a downstream passage 93 becomes negative in pressure relative to an upstream passage 92. When a pressure difference between the upstream passage 92 and the downstream passage 93 becomes large, an umbrella-shaped valve portion 91 of a valving element 90 deforms elastically to move toward downstream. The valve portion 91 is accordingly separated from a valve seat 94, and a supply flow is generated such that a vapor fuel is supplied to the engine. Since the pressure difference between the upstream passage 92 and the downstream passage 93 is large, an external force caused by the pressure difference acts on the valve portion 91 to deform the valve portion 91 drastically. Accordingly, the valve portion 91 is tightly fitted to an opening circumference surface 96 of a port 95 that forms the downstream passage 93.

Figure 13:
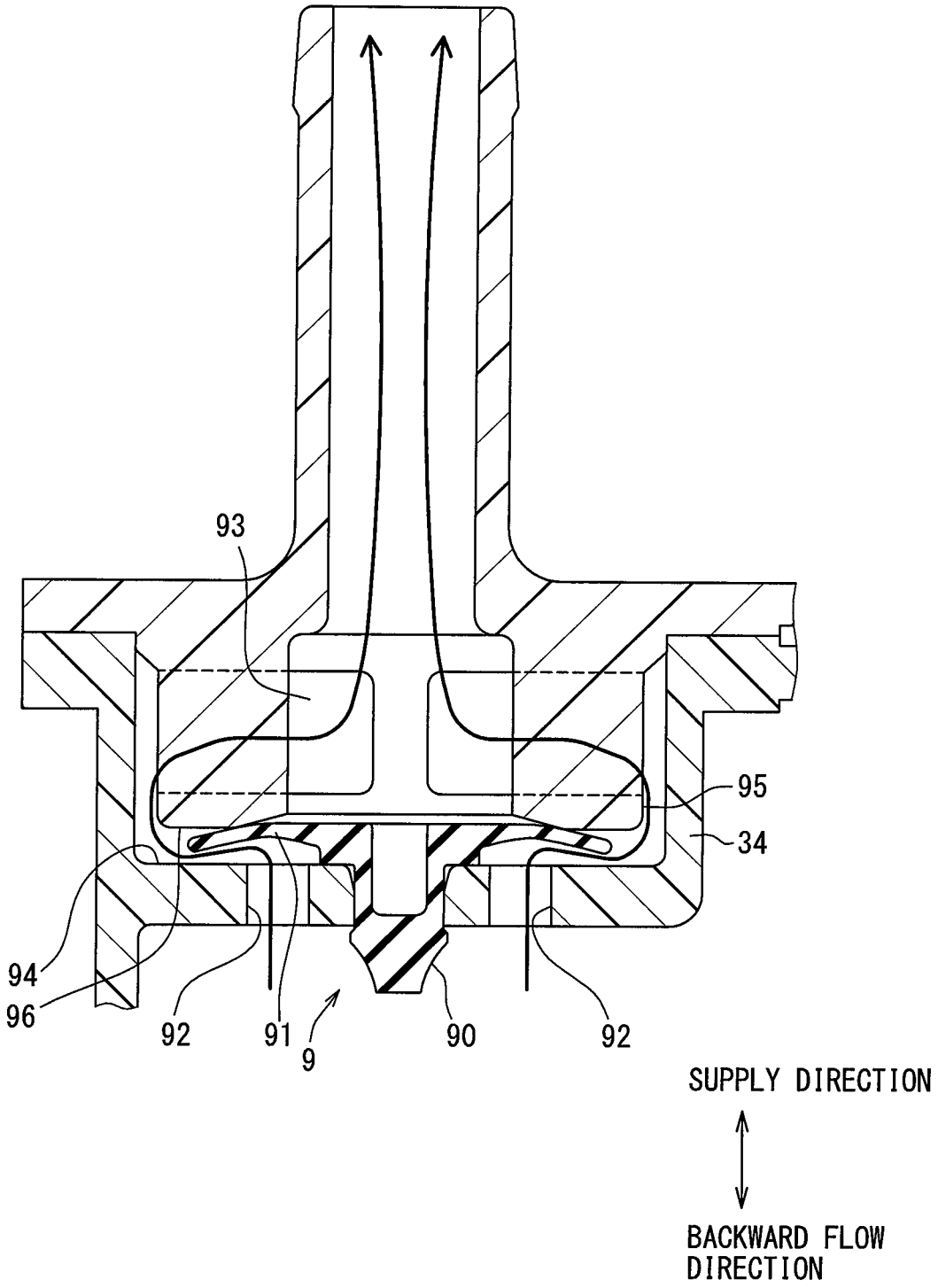
FIG. 13 is a sectional view illustrating the check valve device in a valve open state, according to the comparative example.

As shown in FIG. 13, the valve portion 91 elastically and highly deforms to be fitted to the opening circumference surface 96. The valve portion 91 and the valve seat 94 are widely separated accordingly. In this case, the vapor fuel becomes likely to flow from the upstream passage 92 to the downstream passage 93, and the pressure difference between the upstream passage 92 and the downstream passage 93 reduces. The external force deforming elastically the valve portion 91 toward the opening circumference surface 96 is decreased by the reduction in the pressure difference. Hence, as shown in FIG. 12, the valve portion 91 elastically deforms drastically by its restoring force and approaches the valve seat 94. Finally, the valve portion 91 returns to its original shape and becomes in a valve closed state. The valve closing of the valve portion 91 shuts off the supply of the vapor fuel from the upstream passage 92 to the downstream passage 93. When the downstream passage 93 becomes again negative in pressure relative to the upstream passage 92 due to the intake air pressure of the engine, the valve portion 91 elastically deforms toward downstream as described above. Therefore, the supply flow of the vapor fuel to the engine is generated. Afterwards, the above-described phenomena are repeated. Thus, the valve portion 91 elastically deforms alternately toward the opening circumference surface 96 and the valve seat 94 drastically or frequently. Therefore, the valve portion 91 is subjected to an impact stress repeatedly, and a durability of the valving element 90 may be deteriorated.

Embodiments of the present disclosure will be described hereinafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A check valve device according to a first embodiment of the present disclosure and a vapor fuel supply system including the check valve will be described referring to FIGS. 1 to 6.

A vapor fuel introduced into an intake system 1 of an engine is mixed with a combustion fuel supplied from an injector or the like to the engine. The vapor fuel mixed with the combustion fuel is combusted in an cylinder of the engine. The intake system 1 of the engine includes an intake pipe 10 having one end side connected to an intake manifold 20 of the engine through a throttle valve 21. The intake system 1 is configured by providing a filter 13, a turbocharger 12 and an intercooler 11 in the intake pipe 10. A vapor fuel purge system 2 is configured by connecting a fuel tank 80 and a canister 70 to the intake manifold 20 through a pipe 81, a pipe 71 and a pipe 72.

The filter 13 is located on the most upstream part of the intake pipe 10 and traps dust contained in an intake air. The turbocharger 12 includes an intake-air compressor used for improving a loading efficiency of the intake air. The turbocharger 12 is located on a downstream side of the filter 13 in flow of the intake air or located adjacent to the intake manifold 20. The turbocharger 12 includes a compressor that works in conjunction with a turbine operated by energy of exhaust gas from the engine. The compressor of the turbocharger 12 compresses the intake air flowing out of the filter 13 and supplies the compressed intake air to the intake manifold 20.

The intercooler 11 is a heat exchanger for cooling. The intercooler 11 is located on a downstream side of the turbocharger 12. In the intercooler 11, a heat exchange between the intake air compressed by the turbocharger 12 and an outside air is performed, and the intake air is cooled. The throttle valve 21 is an intake-air adjustment valve which adjusts an open degree of an inlet portion of the intake manifold 20 in conjunction with an acceleration pedal and adjusts an intake air amount introduced into the intake manifold 20. The intake air flows through the filter 13, the turbocharger 12, the intercooler 11 and the throttle valve 21, in this order, and flows into the intake manifold 20. The intake air is mixed with the combustion fuel injected from an injector or the like at a predetermined air-fuel ratio and is burned in the cylinder.

The fuel tank 80 is a container storing a fuel such as gasoline. The fuel tank 80 is connected to an inflow portion **70*a* of the canister 70 through the pipe 81. The canister 70 is a container in which an adsorbent such as activated carbon is enclosed. The canister 70 takes in a vapor fuel generated in the fuel tank 80 from the pipe 81 through the inflow portion 70*a* and adsorbs the vapor fuel onto the adsorbent temporarily. The canister 70 includes a suction portion 70*b*** through which fresh air is drawn from outside. Since the canister 70 includes the suction portion 70*b*, an atmosphere pressure acts on an inside of the canister 70. The canister 70 is capable of easily desorbing the vapor fuel adsorbed onto the adsorbent by the drawn fresh air.

The canister 70 includes an outflow portion 70*c* from which the vapor fuel desorbed from the adsorbent flows out. The outflow portion 70*c* is connected to one end side of the pipe 71. Another end side of the pipe 71 is connected to an inflow portion of a valve device 4. A passage in the pipe 71 is referred to also as a fuel inflow passage through which the fuel flows into the valve device 4. The valve device 4 and a check valve device 3 are connected by an intermediate passage 73 and communicate with each other. An outflow side of the check valve device 3 is connected to one end side of the pipe 72. A passage in the pipe 72 is referred to also as a fuel outflow passage through which the fuel flowing out of the valve device 4 passes. Another end side of the pipe 72 is connected to an inflow portion of the intake manifold 20.

The valve device 4 is an opening-closing device which opens or closes a vapor fuel supply passage, i.e. the intermediate passage 73 and the fuel inflow passage inside the pipe 71. The valve device 4 is capable of allowing or stopping supply of the vapor fuel from the canister 70 to the engine. The valve device 4 is, for example, formed of an electromagnetic valve device including a valving element, an electromagnetic coil and a spring. The valve device 4 opens or closes the vapor fuel supply passage depending on an electromagnetic force generated upon an electric energization of the electromagnetic coil and an urging force of the spring.

The valve device 4 normally keeps the vapor fuel supply passage closed. When the electromagnetic coil is energized by a control device, the electromagnetic force overcomes an elastic force of the spring and the vapor fuel supply passage becomes open. The control device energizes the electromagnetic coil by controlling a duty cycle (duty ratio) that is a ratio of an on time to one cycle time consisting of the on time and an off time of the energization. The valve device 4 is referred to also as a duty control valve. According to the control of the energization, a flow rate of the vapor fuel passing through the vapor fuel supply passage is regulated.

The check valve device 3 is provided between the valve device 4 and the intake pipe 10 or the intake manifold 20 in a supply passage of the vapor fuel from the canister 70 to the intake pipe 10. The check valve device 3 in the supply passage allows an original flow of the vapor fuel from the fuel inflow passage to the fuel outflow passage, and prevents a backward flow of the vapor fuel from the fuel outflow passage to the fuel inflow passage. The check valve device 3 includes a valving element made of resin, and opens the supply passage due to the original flow of the vapor fuel and closes the supply passage due to the backward flow of the vapor fuel.

When the turbocharger 12 is not operated during running of the vehicle (i.e. in a normal purge state), a pressure difference is produced between a negative pressure in the intake manifold 20 caused by a suction action of a piston and the atmosphere pressure acting on the canister 70 upon an opening of the valve device 4 by the control device. The pressure difference makes the vapor fuel adsorbed in the canister 70 flow through the fuel inflow passage, the valve device 4, the intermediate passage 73, the check valve device 3 and the fuel outflow passage, and be sucked into the intake manifold 20.

The vapor fuel sucked in the intake manifold 20 is mixed with the combustion fuel supplied from the injector or the like to the engine, and is combusted in the cylinder of the engine. In the cylinder of the engine, the air-fuel ratio that is a mixing ratio between the combustion fuel and the intake air is controlled to be a predetermined air-fuel ratio. The control device adjusts a purge amount of the vapor fuel by performing a duty control of opening and closing time periods of the valve device 4 so as to maintain the predetermined air-fuel ratio even when the vapor fuel is purged.

When the turbocharger 12 is operated during running of the vehicle (i.e. in a turbocharge purge state), a pressure in the intake manifold 20 becomes a positive pressure because of the compressed intake air. Therefore, the vapor fuel cannot be supplied to the internal combustion engine through the valve device 4. Further, the positive pressure may cause the vapor fuel to flow backward and be released to the atmosphere. In order to prevent the backward flow, the check valve device 3 is provided. The check valve device 3 is required to have durability enough to withstand for long time use and a great number of actuations. The check valve device 3 fulfills an original backward-flow protection function after a long time of use, for example, after actual use for 15 years or after 150,000 miles of vehicle running.

Figure 1:
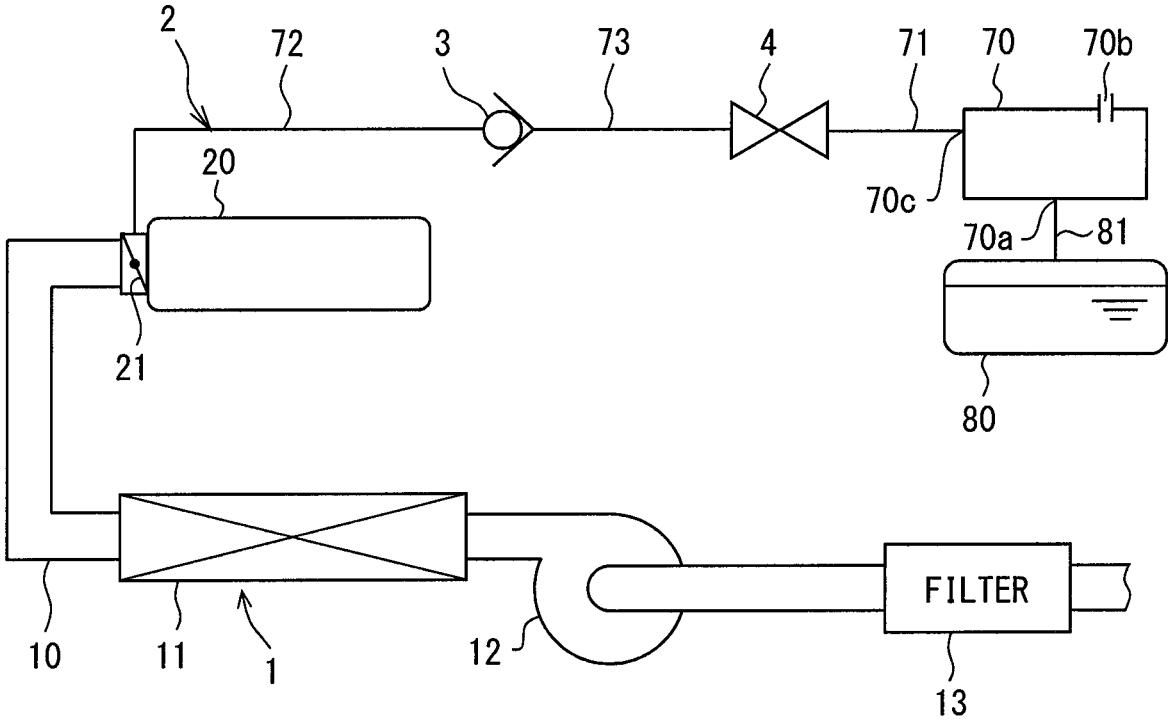
FIG. 1 is a schematic diagram illustrating a vapor fuel supply system including a check valve device, according to a first embodiment of the present disclosure.
Figure 2:
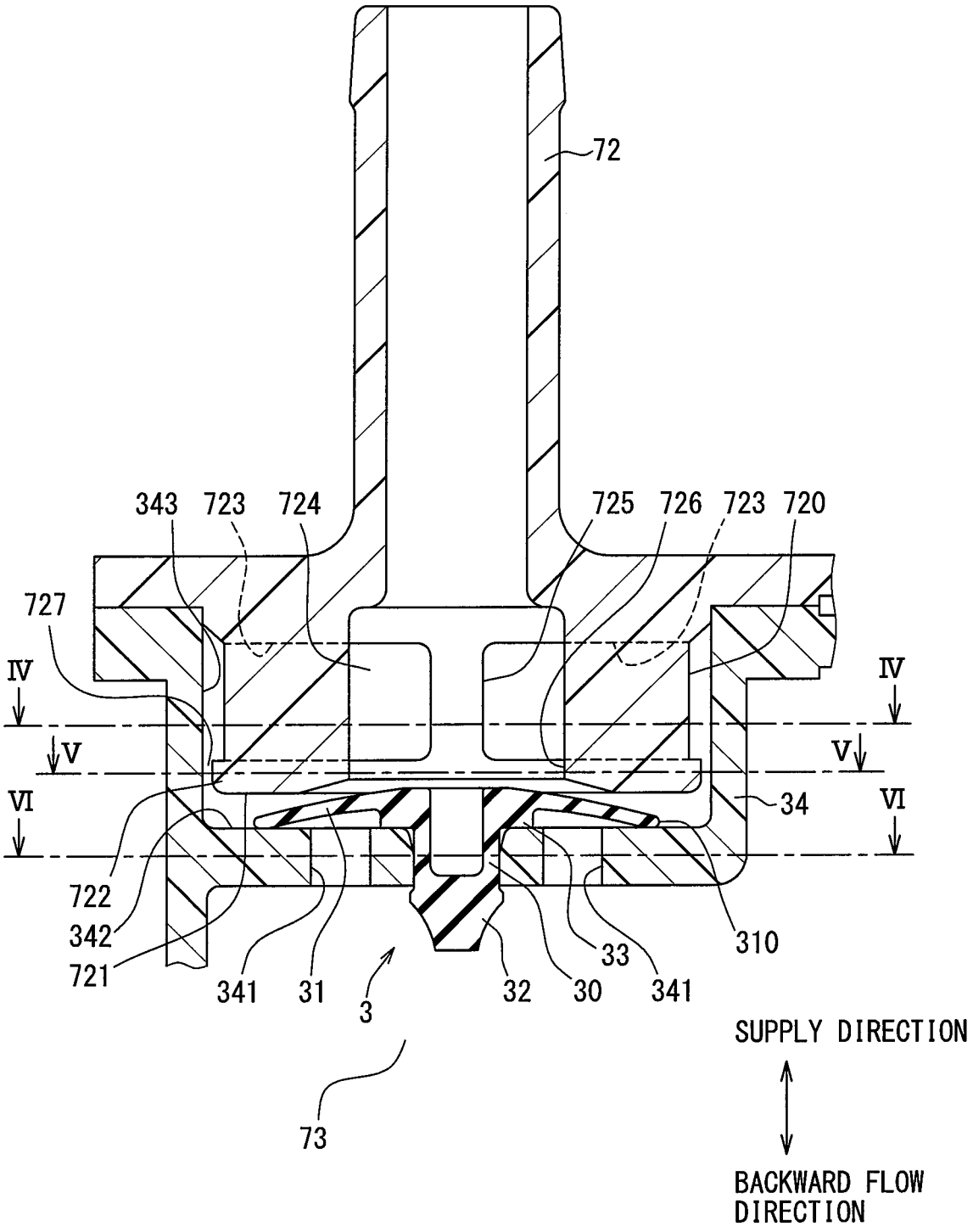
FIG. 2 is a sectional view illustrating the check valve device in a valve closed state, according to the first embodiment.
Figure 3:
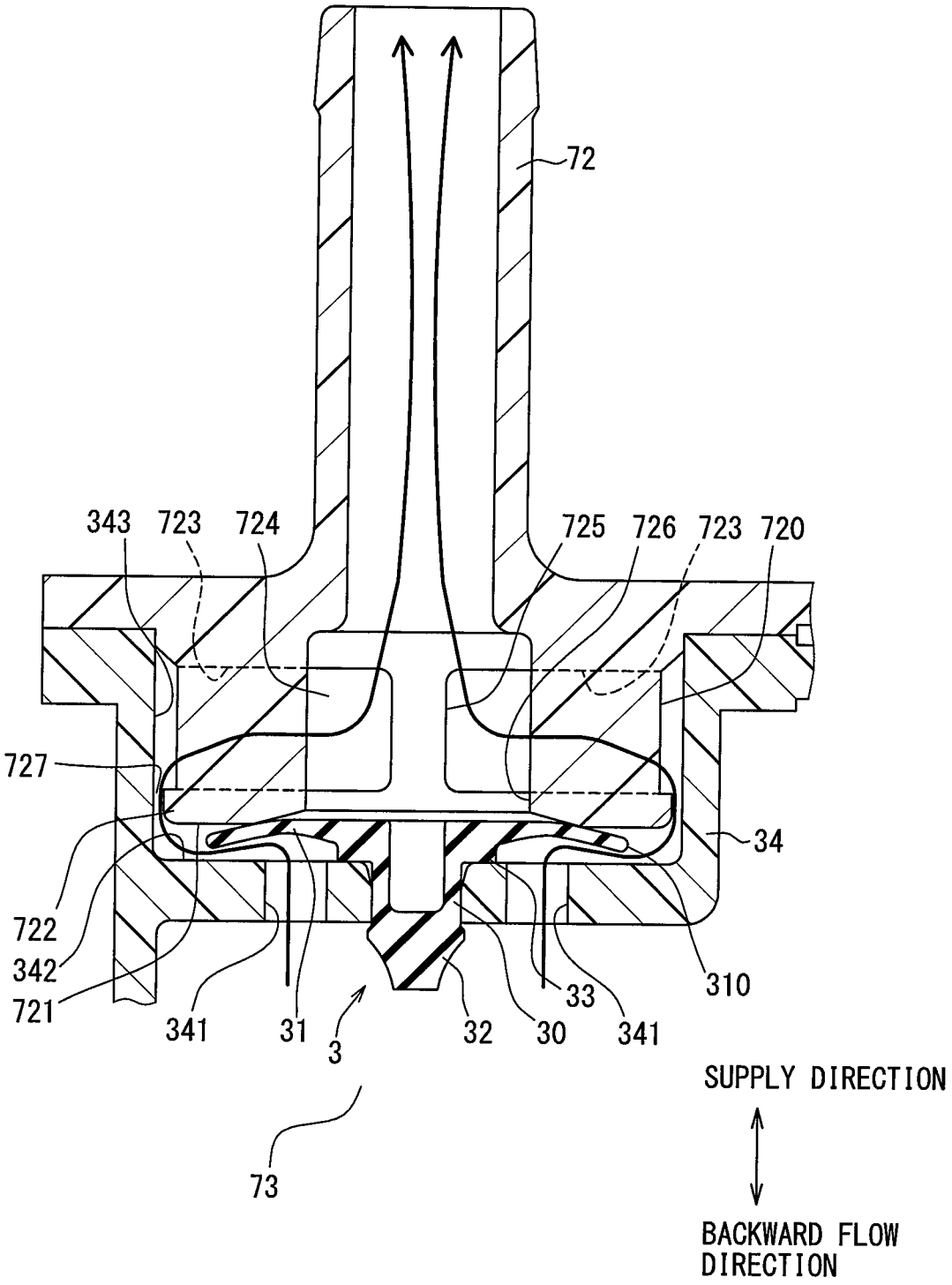
FIG. 3 is a sectional view illustrating the check valve device in a valve open state, according to the first embodiment.
Figure 4:
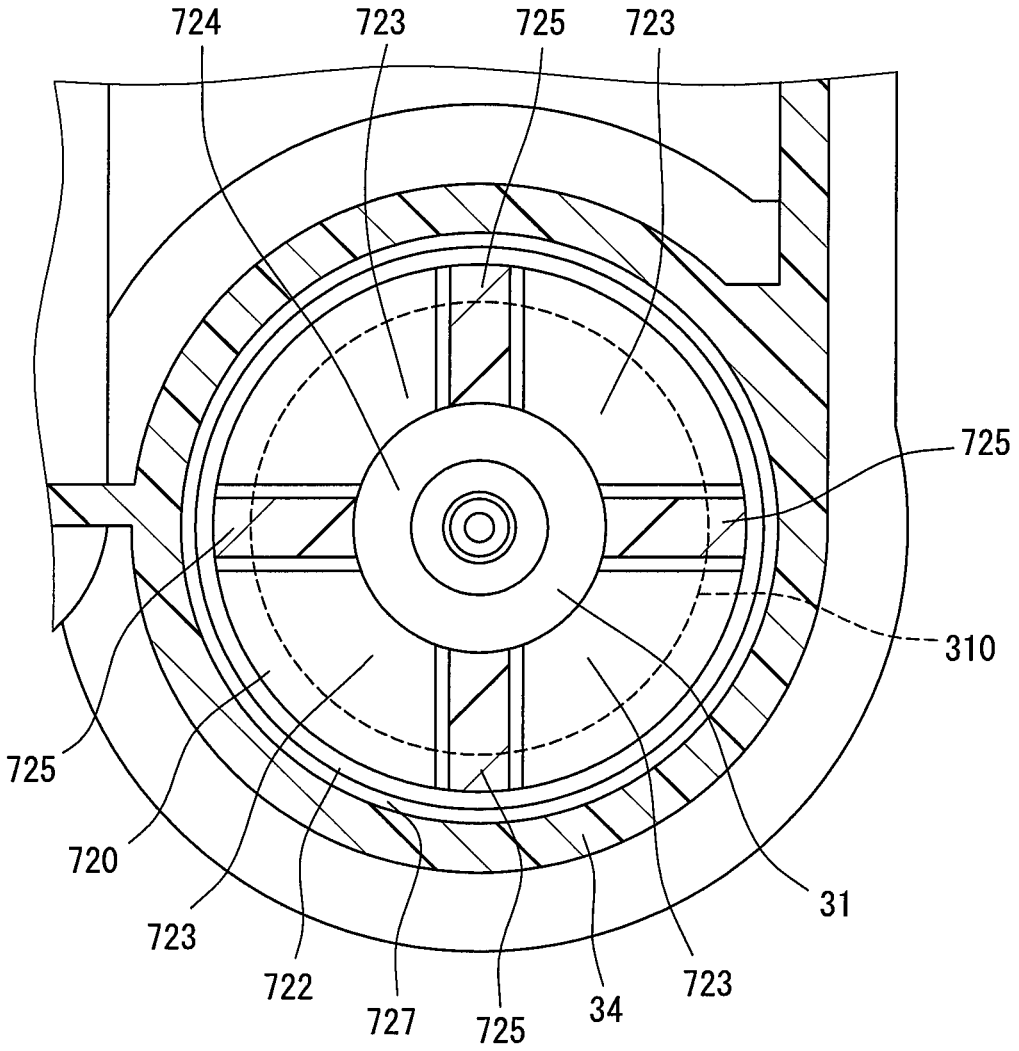
FIG. 4 is a sectional view taken along a line IV-IV of FIG. 2 and illustrating a part of the check valve device according to the first embodiment.
Figure 5:
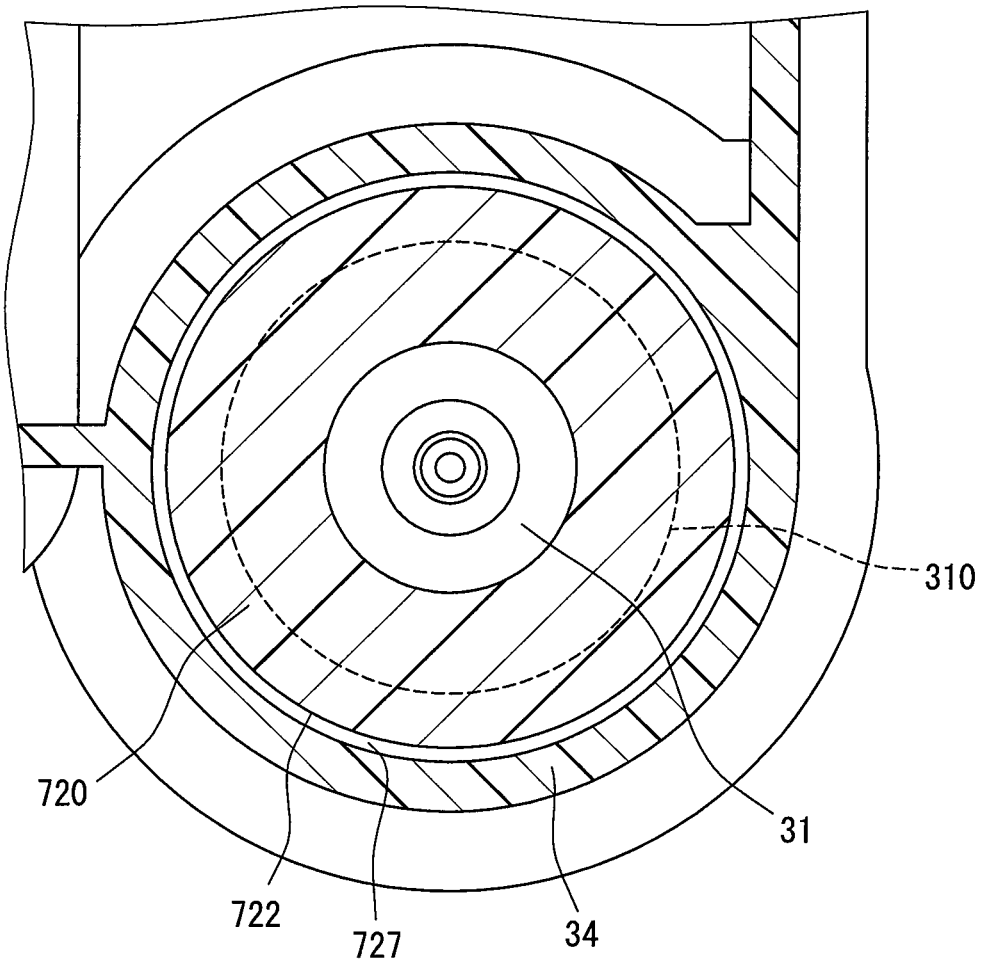
FIG. 5 is a sectional view taken along a line V-V of FIG. 2 and illustrating a part of the check valve device according to the first embodiment.

Next, a configuration of the check valve device 3 will be described referring to FIGS. 2 to 6. FIG. 2 is a sectional diagram showing the check valve device 3 when the check valve device 3 is closed. FIG. 3 is a sectional diagram showing the check valve device 3 when the check valve device 3 is open. The check valve device 3 is provided inside a pipe and a housing which define the intermediate passage 73 and the fuel outflow passage. A housing 34 defining the intermediate passage 73 and the pipe 72 defining the fuel outflow passage are, as shown in FIG. 2, connected to each other, and the intermediate passage 73 and the fuel outflow passage communicates with each other as a sequence of passages. A flange portion provided on an end part of the housing 34 and a flange portion provided on an end part of the pipe 72 are bonded to each other. The housing 34 and the pipe 72 are connected to each other with having a sealing performance at a level enough to prevent the vapor fuel from leaking to outside. The housing 34 is used as an example of an upstream passage forming member that defines an upstream passage through which a fluid such as vapor fuel flows. The pipe 72 is used as an example of a downstream passage forming member through which the vapor fuel flowing out of an inside of the housing 34 is introduced to a passage located further downstream.

The pipe 72 includes a port 720 as a terminal port which protrudes from the flange portion toward the valving element of the check valve device 3. The port 720 includes a downstream passage 724 located downstream of the valving element, and multiple branch passages 723 communicating with the downstream passage 724. The downstream passage 724 is a passage constituting a part or the fuel outflow passage or a passage connecting to the fuel outflow passage. When the valving element is in an open state, the downstream passage 724 forms a passage in which multiple flows of the vapor fuel flowing out of the multiple branch passages 723 merge with each other.

The multiple branch passages 723 are arranged at regular intervals in a circumferential direction around the downstream passage 724 inside the port 720. The multiple branch passages 723 extend radially outward from the downstream passage 724 in a radial direction of the port 720. Each of the multiple branch passages 723 is partitioned from adjacent one of the multiple branch passages 723 by a partition wall 725. The number of the partition walls 725 is same as the number of the branch passages 723. In the first embodiment, the number of the partition walls 725 and the number of the branch passages 723 are four. The port 720 may have a cylindrical shape, and the multiple branch passages 723 may extend in a radial direction of the port 720 perpendicular to an axial direction of the port 720.

The port 720 further includes an opening portion 726 on an end surface facing toward the valving element or downward, and the opening portion 726 communicates with the downstream passage 724. The opening portion 726 and the downstream passage 724 are arranged in a direction of an axis of the pipe 72. An opening circumference surface 721 of the port 720 extending radially from an edge of an opening of the opening portion 726 is facing to a valve portion 31 of the valving element. The valve portion 31 extends radially outward from a valve shaft portion 30 of the valving element and has an umbrella-like shape. The opening circumference surface 721 is an end surface perpendicular to the axial direction of the port 720, and the opening circumference surface 721 is facing to a valve seat 342 and the valve portion 31. An outer circumferential surface of the port 720 may be a lateral surface perpendicular to the opening circumference surface 721, or may be a lateral surface intersecting with the opening circumference surface 721.

Figure 6:
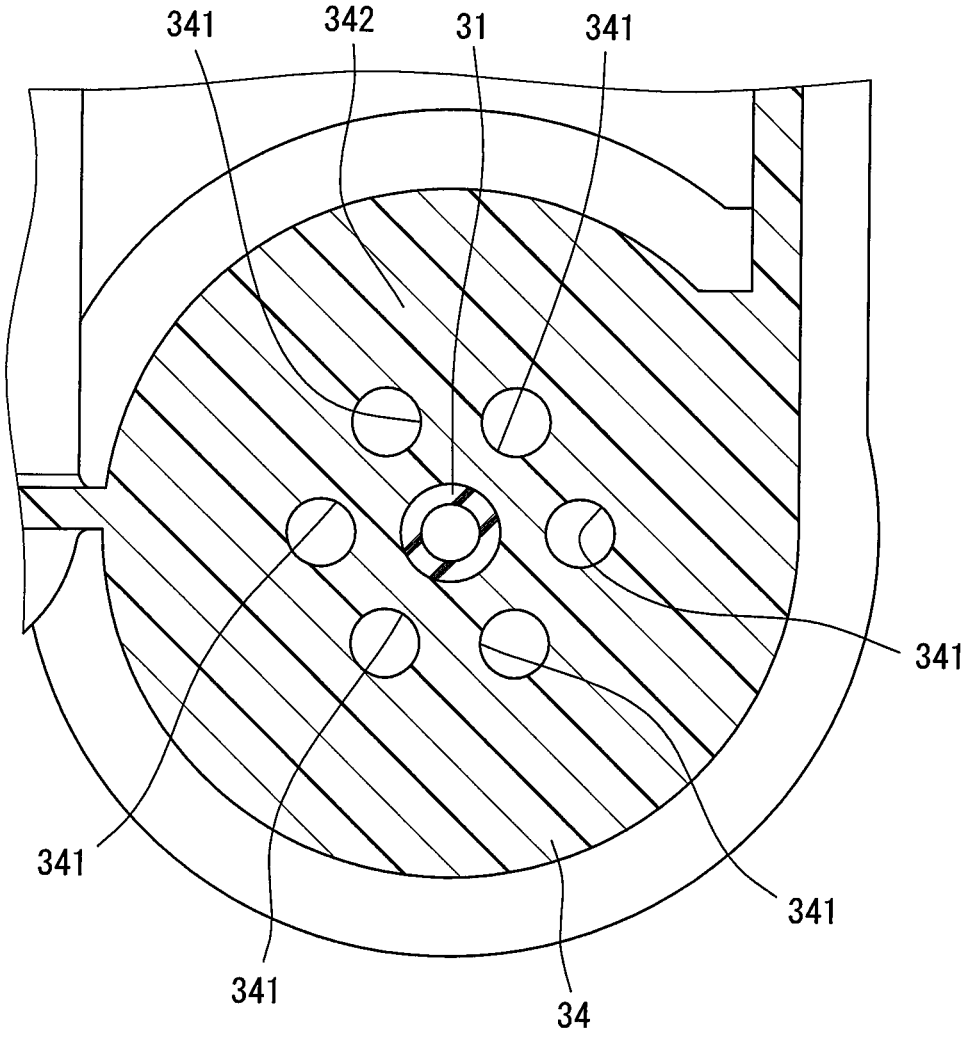
FIG. 6 is a sectional view taken along a line VI-VI of FIG. 2 and illustrating a part of the check valve device according to the first embodiment.

A passage wall of the housing 34 includes multiple fluid passages 341 and the valve seat 342. The multiple fluid passages 341 constitute a passage through which the vapor fuel passes from the intermediate passage 73 to the fuel outflow passage. The multiple fluid passages 341 are arranged at regular intervals in a circular pattern around the valve shaft portion 30 of the valving element supported by the passage wall of the housing 34. In the first embodiment, as shown in FIG. 6, the number of the fluid passages 341 is six, for example. The passage wall, to which the valve shaft portion 30 of the valving element is fixed, includes the valve seat 342 facing to a side of the valve portion 31 opposite from the port 720. The valve seat 342 may be surfaces of the passage wall that are located on a radially inner side and a radially outer side of the multiple fluid passages 341 arranged annularly at regular intervals.

The port 720 further includes a passage narrowing portion 722 that protrudes radially outward from an outer circumferential end surface of the partition wall 725. The passage narrowing portion 722 has a predetermined length in the axial direction of the port 72 or an axial direction of the valving element. The passage narrowing portion 722 is closer to an inner wall surface 343 of the housing 34 surrounding a circumference of the port 720 than an outer circumferential surface of the port 720 other than the passage narrowing portion 722. The outer circumferential surface of the port 720 is an outer surface of the port 720 provided entirely or partially around a central axis of the port 720, and is facing to the inner wall surface 343 of the housing 34 other than the valve seat 342.

The passage narrowing portion 722 protrudes radially outward from the outer circumferential end surface of the partition wall 725 on an entire circumference of the port 720. Therefore, a passage defined between the outer circumferential surface of the port 720 other than the passage narrowing portion 722 and the inner wall surface 343 has a lager cross-sectional area than a passage defined between the passage narrowing portion 722 and the inner wall surface 343.

Hence, the passage narrowing portion 722 constitutes a narrowing portion that locally reduces a cross-sectional area of a passage leading from the fluid passages 341 to the downstream passage 724. A narrowed passage 727 defined between the passage narrowing portion 722 and the inner wall surface 343 of the housing 34 surrounding the circumference of the port 720 is configured to have a cross-sectional area smaller than a total cross-sectional area of the multiple fluid passages 341. Therefore, the narrowed passage 727 is a passage portion located downstream of the valving element and narrowed locally between the multiple fluid passages 341 of the upstream passage and the downstream passage 724. The narrowed passage 727 has a smaller cross-sectional area than a passage located upstream of a passage in which the waiving element and the valve seat 342 are positioned. The narrowed passage 727 may have the smallest cross-sectional area in a passage from the multiple fluid passages 341 to the downstream passage 724. The narrowed passage 727 may be located between the fluid passages 341 and the downstream passage 724 in a flow direction of the fuel vapor. The narrowed passage 727 may be located coaxially with the port 720. The narrowed passage 727 may be located coaxially with the valve seat 342. The narrowed passage 727 may be located coaxially with the valve portion 31.

The check valve device 3 includes the valving element that linearly reciprocates along its central axis so as to contact with or separate from the valve seat 342 configured annually on at least the radially outer side of the multiple fluid passages 341. The valving element is a valve that at least includes the valve shaft portion 30, the valve portion 31 formed integrally with the valve shaft portion 30 and extending radially outward from a downstream end part of the valve shaft portion 30. The valving element has an umbrella-like shape as a whole. The valve shaft portion 30 is fixed to the passage wall of the housing 34, and is supported by the passage wall such that the valve shaft portion 30 is prevented from being displaced during the linear reciprocation of the valve portion 31.

The valving element of the check valve device 3 further includes a stopper portion 32 being a large diameter portion provided in an upstream end part of the valve shaft portion 30 opposite from the valve portion 31 and directed toward the intermediate passage 73, and a large diameter shaft portion 33 provided in the downstream end part of the valve shaft portion 30 adjacent to the valve portion 31. The valve shaft portion 30 is arranged along a flow of the vapor fuel through the multiple fluid passages 341. The upstream end part of the valve shaft portion 30 is located on an upstream side of the passage wall in the flow of the fuel vapor while the downstream end part of the valve shaft portion 30 is located on a downstream side of the passage wall in the flow of the fuel vapor. Therefore, the valving element is made of rubber, in which the valve shaft portion 30, the valve portion 31, the stopper portion 32 and the large diameter shaft portion 33 are integrated.

The stopper portion 32 and the large diameter shaft portion 33 are each, for example, an annular protrusion portion having an outer shape protruding outward from the valve shaft portion 30. The valve shaft portion 30 is supported by the passage wall while the passage wall is held between the stopper portion 32 on a side of the passage wall adjacent to the intermediate passage 73 and the large diameter shaft portion 33 on a side of the passage wall adjacent to the fuel outflow passage. Accordingly, the valving element is attached to the passage wall. In such attachment state of the valving element, only the valve portion 31 in the valving element elastically deforms depending on a pressure of the vapor fuel that is a fluid.

The valving element can be formed by injecting a predetermined material into a metallic mold and hardening the material. For example, the valving element may be made of an elastomer including a variety of rubbers. The valving element may be made of silicone rubber that is rubber-like one of silicone series synthetic resins or may be made of fluorine-contained rubber or fluorosilicone rubber. The valving element is required to have durability under both low temperature and high temperature.

The valve portion 31 has a circular plate shape extending radially outward from a base part integral with the large diameter shaft portion 33 to an outer circumferential edge 310. In a valve closed state or a no-load state shown in FIG. 2, the valve portion 31 has a curved shape in cross-section between the base part and the outer circumferential edge 310 so as to come close to the valve seat 342. The valve portion 31 may have a tapered shape tapered toward the outer circumferential edge 310. The outer circumferential edge 310 is in line contact with a part of the valve seat 342 located radially outward of the fluid passages 341. The outer circumferential edge 310 on entire circumference contacts the valve seat 342. The outer circumferential edge 310 may be made to be thin and sharp such that a contact area between the valve seat 342 and the outer circumferential edge 310 is reduced and a force given to the valve seat 342 from the outer circumferential edge 310 is concentrated.

A middle part of the valve portion 31 between the base part and the outer circumferential edge 310 elastically deforms to move toward the valve seat 342, or the outer circumferential edge 310 elastically deforms to move away from the valve seat 342, depending on a direction of fluid pressure acting on the valve portion 31. As shown in FIG. 2, in the no-load state or in a low pressure state where a relatively low pressure acts on the valve portion 31 in a backward flow direction, the valve portion 31 does not deforms elastically or slightly deforms. In either state, the outer circumferential edge 310 is in contact with the valve seat 342, and the valve portion 31 is thus in line contact with the valve seat 342.

When a backward flow from the intake manifold 20 to the canister 70 is generated in a state where the outer circumferential edge 310 is in contact with the valve seat 342 on the entire circumference, a surface of the valve portion 31 is pressed and elastically deformed to move toward the valve seat 342. By the elastic deformation, the outer circumferential edge 310 is further pressed against the valve seat 342, and a sealing force caused by the line contact between the outer circumferential edge 310 and the valve seat 342 is further increased than the no-load state. Therefore, when a low pressure acts on the surface of the valve portion 31 in the backward flow direction, a fluid flow through the fluid passages 341 can be certainly shut off by the line contact between the outer circumferential edge 310 and the valve seat 342, and leakage in the low pressure state can be limited.

For example, when a negative pressure is generated in the intake manifold 20 due to a suction action of the piston in the normal purge state, a pressure acting on an upstream surface of the valve portion 31 becomes larger than a pressure acting on a downstream surface of the valve portion 31. In this case, as shown in FIG. 3, the valve portion 31 elastically deforms entirely and easily to move away from the valve seat 342. Thus, the outer circumferential edge 310 separates and moves away from the valve seat 342. The motion of the valving element causes the fluid passages 341 to open, and the intermediate passage 73 and the fuel outflow passage communicate with each other. The valving element thus allows the fluid flow through the fluid passages 341. The vapor fuel adsorbed in the canister 70 passes through the valve device 4 and flows into the fluid passages 341 from the intermediate passage 73. Subsequently, the vapor fuel passes through a gap between the valve seat 342 and the outer circumferential edge 310, and is drawn into the intake manifold 20 through the fuel outflow passage. The vapor fuel drawn into the intake manifold 20 is mixed with the combustion fuel that is to be supplied to the engine. The mixture of the vapor fuel and the combustion fuel is combusted in the cylinder of the engine.

When the vapor fuel is supplied to the engine, the downstream passage 724 located downstream of the valving element becomes negative in pressure relative to the fluid passages 341 located upstream of the valving element. Hence, a pressure difference between the fluid passages 341 as the upstream passage and the downstream passage 724 becomes large. Since the pressure difference between the fluid passages 341 and the downstream passage 724 is large, an external force caused by the pressure difference acts on the valve portion 31. Accordingly, the valve portion 31 elastically deforms to stick to the opening circumference surface 721 of the port 720.

As shown in FIG. 3, the vapor fuel passes through the narrowed passage 727 on the way from the fluid passages 341 to the downstream passage 724. Therefore, a pressure in the fluid passages 341 immediately after valve opening of the check valve device 3 becomes not much lower than that immediately before the valve opening. Accordingly, the pressure difference between the fluid passages 341 and the downstream passage 724 can be kept large, and the external force causing the valve portion 31 to elastically deform toward the opening circumference surface 721 does not reduce drastically. The external force is opposed to a restoring force of the valve portion 31 that restores the valve portion 31 to an original shape. Thus, the valve portion 31 does not return to the valve closed state rapidly, and a sharp change in shape of the valve portion 31 can be limited. Therefore, the valve portion 31 changes relatively slowly from the valve open state to the valve closed state. The valve portion 31 elastically deforms so as to gradually approach the valve seat 342 and blocks a supply of the vapor fuel from the fluid passages 341 which are the upstream passage to the downstream passage 724.

Subsequently, when the downstream passage 724 becomes negative in pressure relative to the fluid passages 341 again due to an intake pressure of the engine, the valve portion 31 elastically deforms to move toward a downstream side as described above. Thus, a supply flow of the vapor fuel to the engine is generated. After this, the above described phenomena are repeated. In other words, the motion of the valve portion 31 toward the opening circumference surface 721 and the motion of the valve portion 31 toward the valve seat 342 are alternately repeated through non-drastic change in shape. Therefore, the valve portion 31 can be prevented from being subject to an impact stress.

On the other hand, in a turbocharging state in which the turbocharger 12 operates during vehicle running, a pressure in the intake manifold 20 becomes positive due to compressed intake air. Thus, the pressure acting on the downstream surface of the valve portion 31 becomes much higher than the pressure acting on the upstream surface of the valve portion 31. In this case, the valve portion 31 elastically deforms entirely to move toward the valve seat 342. Especially, a part of the valve portion 31 facing to the fluid passages 341 largely deforms to become in contact with inner circumferential edges of the fluid passages 341. The valve portion 31 largely deforms such that a part of the valve portion 31 between the base part and the outer circumferential edge 310 is recessed in the backward flow direction and closes the fluid passages 341.

As described above, when the vapor fuel flows from the valve device 4 to the intake manifold 20 to generate a flow in a supply direction in a non-turbocharging state (i.e. normal purge state), the fluid pressure acting on the upstream surface of the valve portion 31 causes the valve portion 31 to elastically deform in the supply direction, and the fluid passages 341 are opened. Accordingly, the vapor fuel passes through the fluid passages 341 and flows to the fuel outflow passage and the intake manifold 20.

On the other hand, in the turbocharging state, the intake manifold 20 has a high positive pressure therein, and thus a pressure of the fluid largely acts on the check valve device 3 in an opposite direction from the supply direction. Hence, the vapor fuel is likely to flow backward toward the valve device 4, but the check valve device 3 blocks the backward flow of the vapor fuel. That is, a fluid pressure acts on the downstream surface of the valve portion 31 due to the positive pressure from the intake manifold 20 and causes the valve portion 31 to elastically deform in the backward flow direction. Accordingly, the valve portion 31 tightly contacts the valve seat 342 and prevents the fluid from passing through the fluid passages 341. The vapor fuel does not flow into the valve device 4 from the check valve device 3, and an emission of the vapor fuel to the atmosphere in the turbocharging state can be avoided.

Next, actions and effects provided by the check valve device 3 of the first embodiment will be described. The check valve device 3 is a device capable of limiting a flow of the vapor fuel passing through the fluid passages 341 in one direction. The check valve device 3 includes the valve portion 31, the housing 34 as an example of the upstream passage forming member, the pipe 72 as an example of the downstream passage forming member, and the narrowed passage 727. The valve portion 31 has the shape protruding outward like an umbrella from the valve shaft portion 30, and elastically deforms depending on the direction of the pressure of the vapor fuel. The elastic deformation of the valve portion 31 causes the valve portion 31 to contact with or separate from the valve seat 342 located downstream of the fluid passages 341, thereby preventing or allowing the fluid flow through the fluid passages 341.

The housing 34 has the fluid passages 341 and the valve seat 342, and supports the valve shaft portion 30. The pipe 72 includes the port 720 that has therein the downstream passage 724 through which the vapor fuel flowing out of the fluid passages 341 flows downstream. The pipe 72 is connected to the housing 34 while the port 720 is housed in the housing 34. The narrowed passage 727 is provided between the inner wall surface 343 of the housing 34 other than the valve seat 342 and the outer circumferential surface of the port 720. The narrowed passage 727 has a smaller cross-sectional area than any of the fluid passages 341 and the downstream passage 724.

According to this configuration, the narrowed passage 727 whose passage cross-sectional area is set to be smaller than any of the fluid passages 341 and the downstream passage 724 is located downstream of the fluid passages 341 and the valve portion 31. Hence, the pressure difference between the fluid passages 341 and the downstream passage 724 can be prevented from decreasing drastically when the valve portion 31 is opened. Since the vapor fuel flowing out of the fluid passages 341 upon opening of the valve portion 31 passes through the narrowed passage 727 smaller than the fluid passages 341 in cross-sectional area, the narrowed passage 727 contributes to keeping of a pressure in the fluid passages 341 higher than a pressure in the downstream passage 724.

Therefore, the pressure difference between the fluid passages 341 and the downstream passage 724 can be maintained for a while, and the pressure difference can be reduced gradually. Since a decrease rate of the pressure difference can be reduced, the valve portion 31 can be prevented from drastically deforming elastically due to the restoring force and drastically returning to the original shape so as to approach the valve seat 342. A frequency of alternate elastic deformation of the valve portion 31 between an open state and a closed state can be reduced. The valve portion 31 can be prevented from being subjected to an impact stress repeatedly. Thus, the check valve device 3 of the present embodiment is capable of limiting reduction in durability of the valve portion 31. Further, the check valve device 3 is capable of limiting a drastic deformation of the valve portion 31 in transition between the open state and the closed state. Therefore, flapping of the valve portion 31 can be prevented, and a noise caused by the flapping can be limited.

The narrowed passage 727 is provided between the inner wall surface 343 of the housing 34 other than the valve seat 342 and the outer circumferential surface of the port 720. Thus, the valve seat 342 does not face directly to the narrowed passage 727. Accordingly, the narrowed passage 727 can be prevented from affecting the elastic deformation of the valve portion 31, and the check valve device 3 which does not obstruct the movement of the valve portion 31 in valve opening or valve closing can be provided.

The check valve device 3 is capable of preventing for a long period a local deterioration of the valve portion 31 caused by repetition of switching between the open state and the closed state. The check valve device 3 is capable of obtaining both a high durability and a high seal performance for a long period.

Since the vapor fuel supply system according to the first embodiment includes the above-described check valve device 3 that reduces deterioration of durability, the vapor fuel supply system is capable of delivering a desired performance for a long period of time.

The opening circumference surface 721 of the port 720 intersecting with or orthogonal to the outer circumferential surface of the port 720 faces to the valve seat 342 and the valve portion 31. The narrowed passage 727 is formed between the passage narrowing portion 722 and the inner wall surface 343 of the housing 34, and the passage narrowing portion 722 is provided on the outer circumferential surface of the port 720 and protrudes toward the inner wall surface 343 of the housing 34 more than the other parts of the port 720.

According to this configuration, the passage narrowing portion 722 can be provided on the outer circumferential surface of the port 720 that does not face to the valve seat 342 and the valve portion 31. Therefore, the passage narrowing portion 722 which does not pose any obstacle to behavior of the valve portion 31 can be provided.

Second Embodiment

Figure 8:
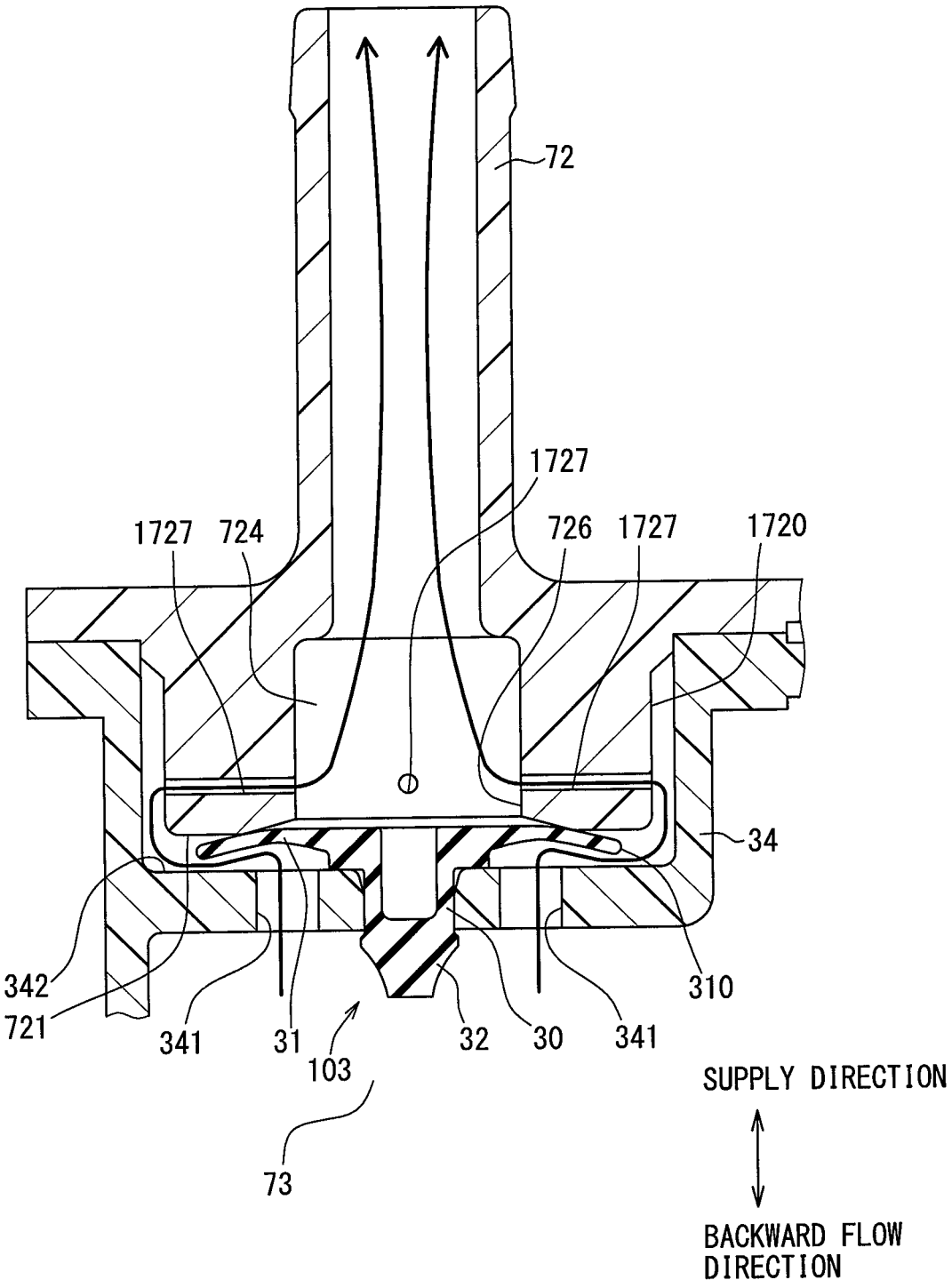
FIG. 8 is a sectional view illustrating the check valve device in a valve open state, according to the second embodiment.
Figure 9:
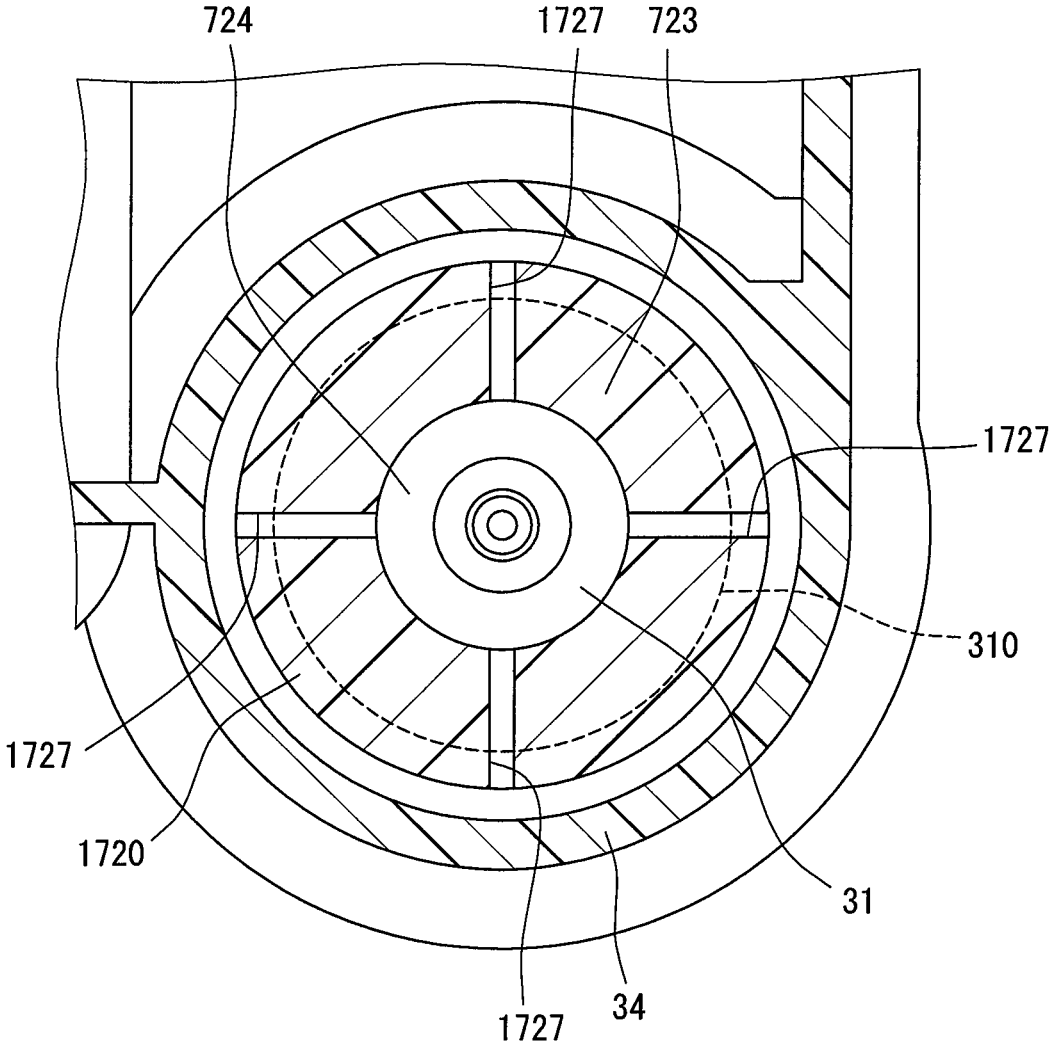
FIG. 9 is a sectional view taken along a line IX-IX of FIG. 7 and illustrating a part of the check valve device according to the second embodiment.

In a second embodiment, a check valve device 103 will be described as a modification of the check valve device 3 of the first embodiment with reference to FIGS. 7 to 9. In each figure, a part having the same configuration as the first embodiment will be assigned the same numeral and exerts the same actions and effects. The configurations, actions or effects which are not mentioned particularly in the second embodiment are the same as the first embodiment. Only different points from the first embodiment will be described below. The part in the second embodiment which has a similar configuration to the first embodiment is considered to exert the similar actions and effects to the first embedment. The check valve device 103 can be used for the fuel vapor supply system of the first embodiment.

Figure 7:
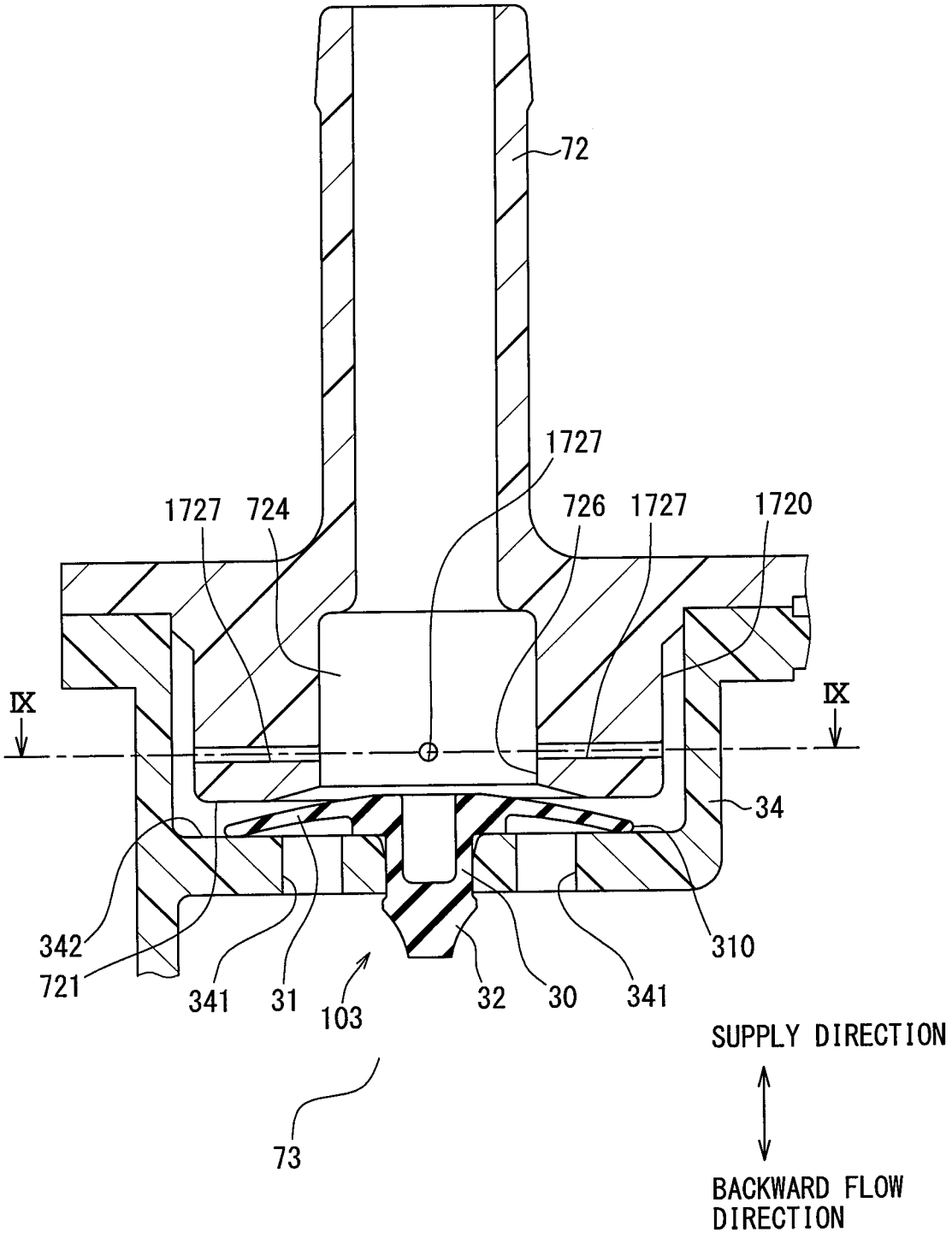
FIG. 7 is a sectional view illustrating the check valve device in a valve closed state, according to a second embodiment of the present disclosure.

FIG. 7 is a sectional diagram showing the check valve device 103 when the check valve device 103 is closed. FIG. 8 is a sectional diagram showing the check valve device 103 when the check valve device 103 is open. A narrowed passage 1727 of the check valve device 103 of the second embodiment is different from the narrowed passage 727 of the check valve device 3 of the first embodiment. A port 1720 of the check valve device 103 includes the narrowed passage 1727 that extends through the port 1720 from an inner war surface of the port 1720 to an outer circumferential surface of the port 1720. An upstream end of the narrowed passage 1727 communicates with a passage formed between the outer circumferential surface of the port 1720 and an inner wall surface 343 of a housing 34. A downstream end of the narrowed passage 1727 communicates with a downstream passage 724 formed inside the port 1720.

The check valve device 103 includes multiple number of the narrowed passage 1727. The multiple narrowed passages 1727 are provided at regular intervals in a circular pattern around the downstream passage 724. In the second embodiment, as shown in FIG. 9, the number of the narrowed passages 1727 is four, for example. The downstream passage 724 forms a passage where vapor fuels flowing out of the multiple narrowed passages 1727 merge with each other when a valving element is in a valve opening state. The multiple narrowed passages 1727 may be arranged coaxially with the port 1720. The multiple narrowed passages 1727 may be arranged coaxially with a valve seat 342. The multiple narrowed passages 1727 may be arranged coaxially with the valve portion 31.

A total cross-sectional area of the multiple narrowed passages 1727 is smaller than a cross-sectional area of the passage formed between the outer circumferential surface of the port 1720 and the inner wall surface 343. The total cross-sectional area of the multiple narrowed passages 1727 is set to be smaller than a total cross-sectional area of multiple fluid passages 341 and a cross-sectional area of the downstream passage 724. The multiple narrowed passages 1727 forms a passage having the smallest cross-sectional area in a region from the multiple fluid passages 341 to the downstream passage 724. Therefore, the multiple narrowed passages 1727 is a passage portion located downstream of the valving element and narrowed locally between the multiple fluid passages 341 that is an upstream passage and the downstream passage 724.

In the check valve device 103 of the second embodiment, the narrowed passage 1727 is a passage extending through the port 1720 and having an upstream end through which the vapor fuel flowing out of the multiple fluid passages 341 flows while a downstream end of the narrowed passage 1727 is connected to the downstream passage 724. According to this configuration, the valve seat 342 is not in direct contact to the narrowed passage 1727. Thus, the narrowed passage 1727 can be prevented from affecting an elastic deformation of a valve portion 31, and the check valve device 103 which does not obstruct the movement of the valve portion 31 in valve opening or valve closing can be provided.

Third Embodiment

Figure 10:
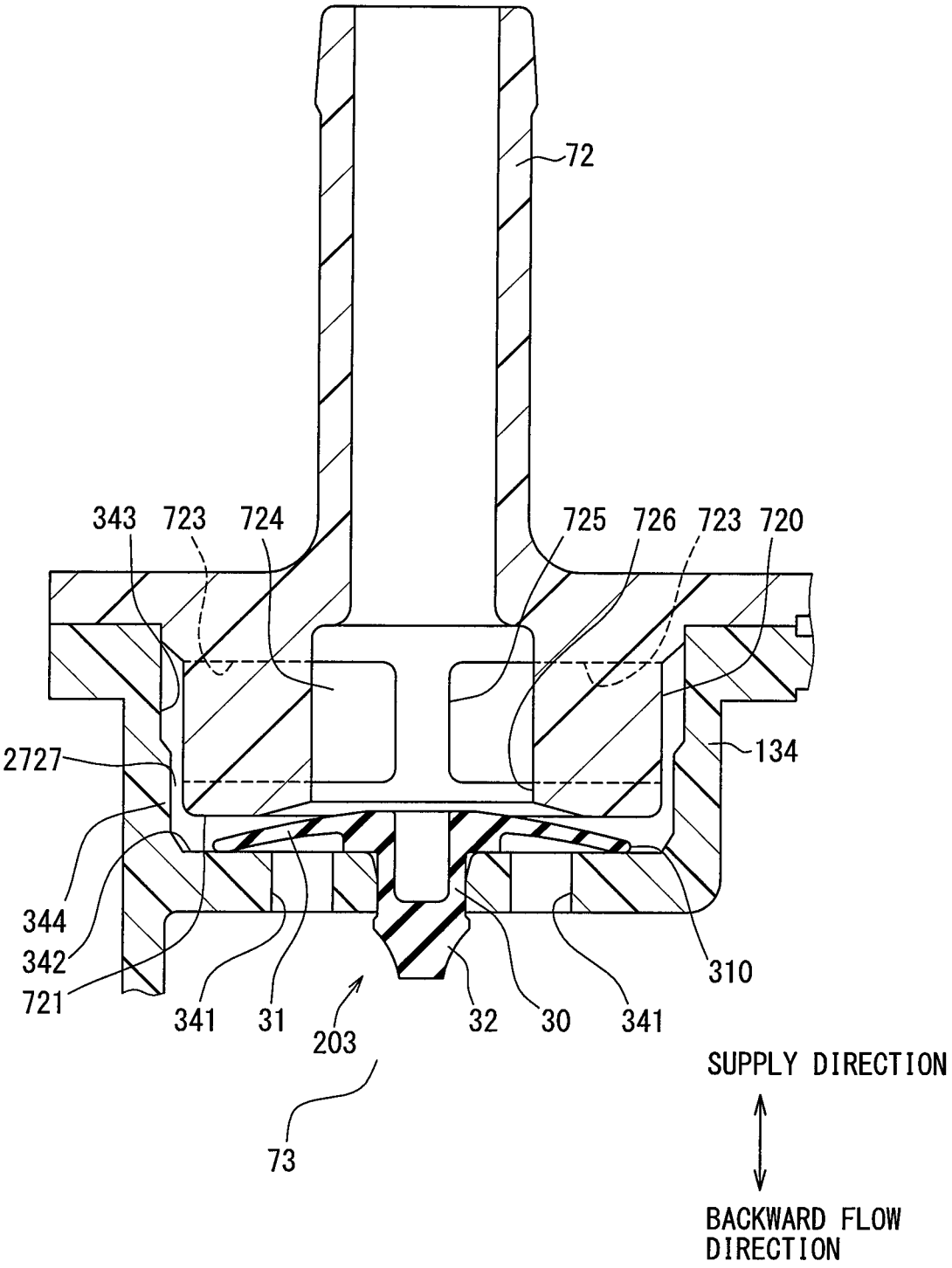
FIG. 10 is a sectional view illustrating the check valve device in a valve closed state, according to a third embodiment of the present disclosure.
Figure 11:
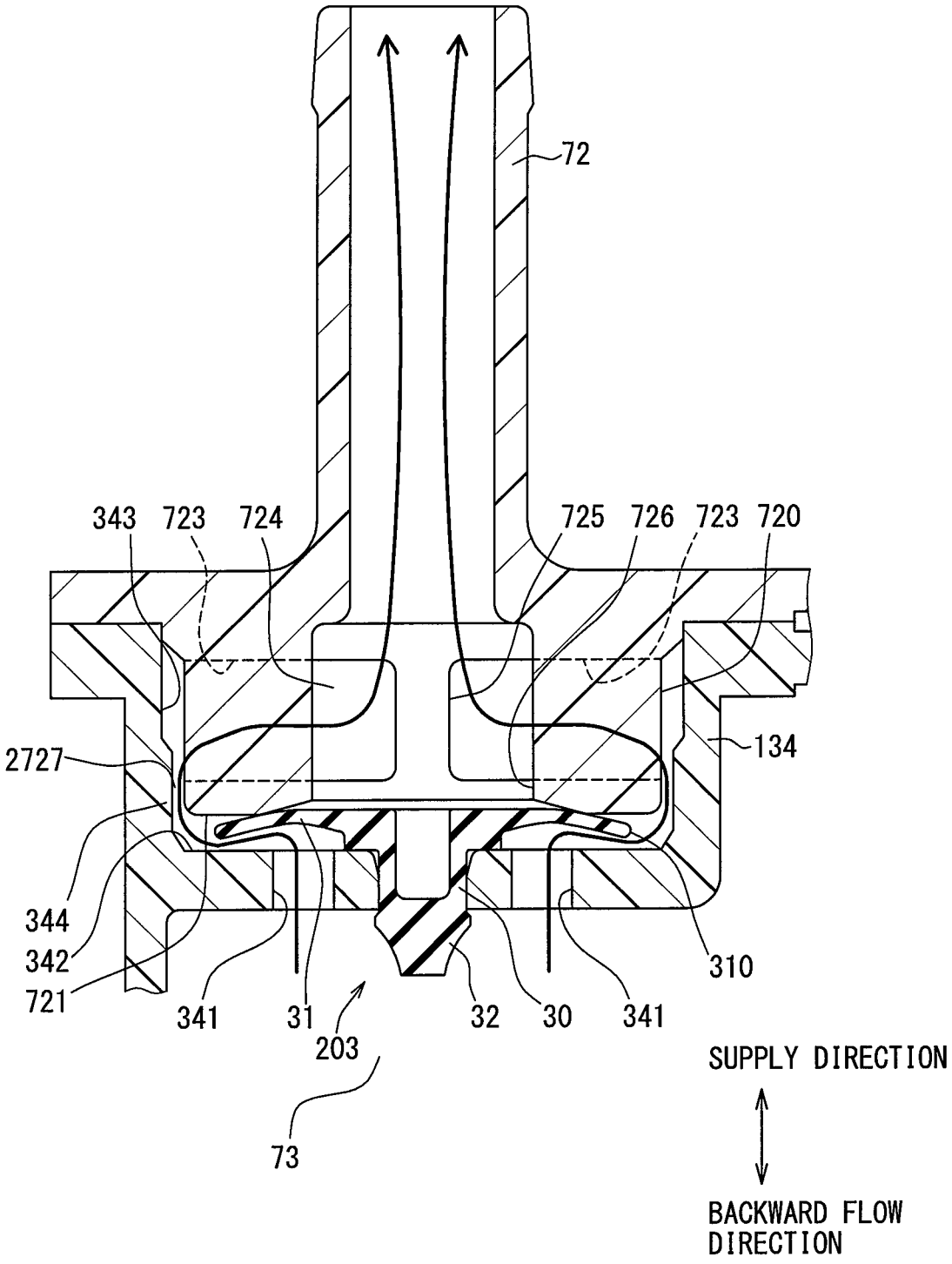
FIG. 11 is a sectional view illustrating the check valve device in a valve open state, according to the third embodiment.

In a third embodiment, a check valve device 203 will be described as a modification of the check valve device 3 of the first embodiment with reference to FIGS. 10 and 11. In FIGS. 10 and 11, a part having the same configuration as the first embodiment will be assigned the same numeral and exerts the same actions and effects. The configurations, actions or effects which are not mentioned particularly in the third embodiment are the same as the first embodiment. Only different points from the first embodiment will be described below. The part in the third embodiment which has a similar configuration to the first embodiment is considered to exert the similar actions and effects to the first embedment. The check valve device 203 can be used for the fuel vapor supply system of the first embodiment.

FIG. 10 is a sectional diagram showing the check valve device 203 when the check valve device 203 is closed. FIG. 11 is a sectional diagram showing the check valve device 203 when the check valve device 203 is open. A passage narrowing portion 344 defining a narrowed passage 2727 of the check valve device 203 of the third embodiment is different from the passage narrowing portion 722 defining the narrowed passage 727 of the check valve device 3 of the first embodiment. The housing 134 includes the passage narrowing portion 344 protruding radially inward from an inner wall surface 343 of the housing 134. The passage narrowing portion 34/1 has a predetermined length along an axial direction of the housing 134 or a valving element. The passage narrowing portion 344 is closer to a port 720 of a pipe 72 than the other parts of the inner wall surface 343.

The passage narrowing portion 344 protrudes radially inward from the inner wall surface 343 over an entire circumference of the inner wall surface 343 in a circumferential direction. Therefore, a passage defined between the inner wall surface 343 other than the passage narrowing portion 344 and the outer circumferential surface of the port 720 over the entire circumference of the inner wall surface 343 is larger in cross-sectional area than a passage defined between the passage narrowing portion 344 and the outer circumferential surface of the port 720.

The passage narrowing portion 344 locally reduces a cross-sectional area of a passage leading from fluid passages 341 to the downstream passage 724. The narrowed passage 2727 defined between the passage narrowing portion 344 and the outer circumferential surface or the port 720 is configured to have a cross-sectional area smaller than a total cross-sectional area of the multiple fluid passages 341. Therefore, the narrowed passage 2727 is a passage portion located downstream of the valving element and narrowed locally between the multiple fluid passages 341 of the upstream passage and the downstream passage 724. The narrowed passage 2727 has a smaller cross-sectional area than a passage located upstream of a passage in which the valving element and a valve seat 342 are positioned. The narrowed passage 2727 may have the smallest cross-sectional area in a passage from the multiple fluid passages 341 to the downstream passage 724. The narrowed passage 2727 may be located coaxially with the port 720. The narrowed passage 2727 may be located coaxially with the valve seat 342. The narrowed passage 2727 may be located coaxially with the valve portion 31.

According to the check valve device 203 of the third embodiment, the narrowed passage 2727 is defined between the passage narrowing portion 344 and the outer circumferential surface of the port 720, and the passage narrowing portion 344 protrudes from the inner wall surface 343 of the housing 34 toward the outer circumferential surface of the port 720 more than the other parts of the inner wall surface 343. According this configuration, the valve seat 342 is not in direct contact with the narrowed passage 2727. Hence, the narrowed passage 2727 can be prevented from affecting an elastic deformation of a valve portion 31, and the check valve device 203 which does not obstruct the movement of the valve portion 31 in valve opening or valve closing can be provided.

Although the present disclosure has been fully described in connection with the preferred embodiments thereof with reference to the accompanying drawings, the present disclosure is not limited to the embodiments, and it is to be noted that various changes and modifications described below will become apparent to those skilled in the art.

In the above-described embodiments, the upstream passage forming member is the housing 34, and the downstream passage forming member is the pipe 72, but these passage forming members are not limited to these embodiments. For example, the upstream passage forming member may be formed by the housing 34 or a pipe, and the downstream passage forming member may be formed by the pipe 72 or a housing.

In the above-described embodiments, the valving element is made of rubber entirely, but the material forming the valving element is not limited to this embodiment. For example, at least, the valving element may be formed of a material enabling the valve portion 31 to elastically deform depending on a fluid pressure. Therefore, the valve shaft portion 30 and so on may not be made of rubber. In this case, the valve shaft portion 30 and the valve portion 31 made of an elastically deformable material are may be formed integrally with each other by two-color molding, for example.

In the above-described embodiments, the valve portion 31 has a sectional shape that becomes closer to the valve seat 342 gradually from the base part to the outer circumferential edge 310. The valve portion 31 may has a cross-sectional shape curved partially or bent partially in a region from the base part to the outer circumferential edge 310.

In the above-described embodiments, the port 720 includes the opening portion 726 open toward the valve shaft portion 30 of the valving element, but the port 720 may not include the opening portion 726. The fluid passages 341 of the housing 34 are connected to the downstream passage 724 through the narrowed passage 727 without bypassing the narrowed passage 727.

Additional advantages and modifications will readily occur to those skilled in the art. The disclosure in its broader terms is therefore not limited to the specific details, representative apparatus, and illustrative examples shown and described.

What is claimed is:

1. A check valve device capable of limiting a flow of a vapor fuel passing through a fluid passage in one direction, the check valve device comprising:

a valve portion extending radially outward from a valve shaft, the valve portion being elastically deformable depending on a direction of a pressure of the vapor fuel, the valve portion being configured to prevent or allow a flow of the vapor fuel through the fluid passage by contacting with or separating from a valve seat located downstream of the fluid passage in accordance with an elastic deformation of the valve portion;

an upstream passage forming member including the fluid passage and the valve seat, and supporting and fixing the valve shaft;

a downstream passage forming member including a terminal protrusion having therein a downstream passage through which the vapor fuel passed out of the fluid passage flows downstream, the downstream passage forming member being connected to the upstream passage forming member while the terminal protrusion protrudes toward the upstream passage forming member to be housed in the upstream passage forming member, the valve portion being elastically deformed to contact an end surface of the terminal protrusion by the pressure of the vapor fuel when the valve portion is separated from the valve seat; and a narrowed passage having a cross-sectional area set to be smaller than each of the fluid passage and the downstream passage, wherein the fluid passage is an orifice located adjacent to the valve seat, the end surface of the terminal protrusion is oblique or perpendicular to an outer circumferential surface of the terminal protrusion and faces the valve seat and the valve portion, the terminal protrusion protrudes toward the valve portion from a part of the downstream passage forming member connected to the upstream passage forming member, and the narrowed passage is provided between an inner wall surface of the upstream passage forming member other than the valve seat and the outer circumferential wall surface of the terminal protrusion directly facing the inner wall surface of the upstream passage forming member.

2. The check valve device according to claim 1, wherein the terminal protrusion has an end surface intersecting with or perpendicular to the outer circumferential surface of the terminal protrusion, the end surface facing to the valve seat and the valve portion, and the narrowed passage is formed between the inner wall surface of the upstream passage forming member and a passage narrowing portion provided on the outer circumferential surface of the terminal protrusion, the passage narrowing portion protruding more than another part of the outer circumferential surface toward the inner wall surface of the upstream passage forming member.

3. The check valve device according to claim 1, wherein the narrowed passage is a passage extending through the terminal protrusion, and has an upstream end into which the vapor fuel from the fluid passage flows, and a downstream end connected to the downstream passage.

4. The check valve device according to claim 1, wherein the narrowed passage is provided between the outer circumferential surface of the terminal protrusion and a passage narrowing portion provided on the inner wall surface of the downstream passage forming member, the passage narrowing portion protruding more than another part of the inner wall surface toward the outer circumferential surface of the terminal protrusion.

5. A vapor fuel supply system comprising:

a fuel tank storing fuel;

a canister adsorbing a vapor fuel generated in the fuel tank when the vapor fuel is introduced in the canister, the canister being capable of desorbing the adsorbed vapor fuel;

an intake manifold of an internal combustion engine that mixes and burns a combustion fuel and the vapor fuel desorbed from the canister;

an electromagnetic valve device capable of permitting or prohibiting supply of the vapor fuel from the canister to the internal combustion engine;

the check valve device according to claim 1, the check valve device limiting a backward flow of the vapor fuel from the internal combustion engine to the electromagnetic valve device; and a filter, a turbocharger and an intercooler provided in an intake pipe connected to the intake manifold.

6. The check valve device according to claim 1, wherein the narrowed passage is located between the fluid passage of the upstream passage forming member and the downstream passage of the downstream passage forming member in a flow direction of the vapor fuel.

7. The check valve device according to claim 2, wherein the narrowed passage is provided over an entire circumference of the terminal protrusion to have an annular shape continuously surrounding the terminal protrusion.

8. The check valve device according to claim 7, wherein the narrowed passage is located coaxially with the valve portion.

9. The check valve device according to claim 3, wherein a plurality of the narrowed passages are provided at regular intervals in a circular pattern around the downstream passage.

10. The check valve device according to claim 9, wherein the plurality of narrowed passages are arranged coaxially with the valve portion.

11. The check valve device according to claim 4, wherein the narrowed passage is provided over an entire circumference of the terminal protrusion to have an annular shape continuously surrounding the terminal protrusion.

12. The check valve device according to claim 11, wherein the narrowed passage is located coaxially with the valve portion.

13. The check valve device according to claim 1, wherein the terminal protrusion protrudes in a protruding direction toward the upstream passage forming member, and a dimension of the end surface of the terminal protrusion in a direction perpendicular to the protruding direction is larger than a diameter of the valve portion.

14. The check valve device according to claim 1, wherein the terminal protrusion protrudes in a protruding direction toward the upstream passage forming member, and a lateral side of the terminal protrusion facing perpendicular to the protruding direction has an inlet allowing the vapor fuel passed out of the fluid passage to flow into the downstream passage of the terminal protrusion.

15. A check valve device capable of limiting a flow of a vapor fuel passing through a fluid passage in one direction, the check valve device comprising:

a valve portion extending radially outward from a valve shaft, the valve portion being elastically deformable depending on a direction of a pressure of the vapor fuel, the valve portion being configured to prevent or allow a flow of the vapor fuel through the fluid passage by contacting with or separating from a valve seat located downstream of the fluid passage in accordance with an elastic deformation of the valve portion;

an upstream passage forming member including the fluid passage and the valve seat, and supporting and fixing the valve shaft;

a downstream passage forming member including a terminal protrusion having therein a downstream passage through which the vapor fuel passed out of the fluid passage flows downstream, the downstream passage forming member being connected to the upstream passage forming member while the terminal protrusion protrudes toward the upstream passage forming member to be housed in the upstream passage forming member; and a narrowed passage having a cross-sectional area set to be smaller than each of the fluid passage and the downstream passage, wherein the terminal protrusion protrudes in a protruding direction toward the upstream passage forming member, a lateral side of the terminal protrusion facing perpendicular to the protruding direction has an inlet allowing the vapor fuel passed out of the fluid passage to flow into the downstream passage of the terminal protrusion, the fluid passage is an orifice located adjacent to the valve seat, the end surface of the terminal protrusion is oblique or perpendicular to an outer circumferential surface of the terminal protrusion and faces the valve seat and the valve portion, the terminal protrusion protrudes toward the valve portion from a part of the downstream passage forming member connected to the upstream passage forming member, and the narrowed passage is provided between an inner wall surface of the upstream passage forming member other than the valve seat and the outer circumferential wall surface of the terminal protrusion directly facing the inner wall surface of the upstream passage forming member.

16. The check valve device according to claim 1, wherein the fluid passage orifice is located at the valve seat.

17. The check valve device according to claim 1, wherein the fluid passage orifice extends through the upstream passage forming member.

18. The check valve device according to claim 1, wherein the fluid passage orifice includes a plurality of fluid passage orifices arranged at regular intervals in a circular pattern around the valve shaft.

19. The check valve device according to claim 15, wherein the fluid passage orifice is located at the valve seat.

20. The check valve device according to claim 15, wherein the fluid passage orifice includes a plurality of fluid passage orifices arranged at regular intervals in a circular pattern around the valve shaft.

* * * * *